United States Patent [19]

Ahrens

[11] 4,362,101

[45] Dec. 7, 1982

[54] VARIABLE IMPRESSION HAND STAMP

[75] Inventor: Robert H. Ahrens, Janesville, Wis.

[73] Assignee: Schwaab, Inc., Milwaukee, Wis.

[21] Appl. No.: 170,038

[22] Filed: Jul. 18, 1980

[51] Int. Cl.[3] ..... B41K 1/38; B41F 27/00

[52] U.S. Cl. ..... 101/327; 101/368; 101/382 MV

[58] Field of Search ..... 101/125, 109, 287, 288, 101/316, 327, 333, 371, 382 MV, 405, 406, DIG. 5, DIG. 15, 93.02, 93.03, 93.29, 93.43, 93.46, 379; 400/137.3, 172; 346/142; 46/234; 335/237

[56] References Cited

U.S. PATENT DOCUMENTS

| | | | |
|---|---|---|---|
| 42,819 | 5/1864 | Jenks | 101/406 |
| 1,109,480 | 9/1914 | Stevens | 101/406 |
| 1,815,154 | 7/1931 | Larson | 101/405 X |
| 1,952,302 | 3/1934 | Weissman | 101/405 |
| 2,620,731 | 12/1952 | Slonneger | 101/405 |
| 2,801,583 | 8/1957 | Loushay | 101/287 X |
| 3,043,218 | 7/1962 | Wick et al. | 101/287 |
| 3,242,855 | 3/1966 | Noll et al. | 101/DIG. 5 |
| 3,376,812 | 4/1968 | Sterling | 101/327 |
| 3,703,142 | 11/1972 | Mimlitch | 101/406 |
| 4,044,455 | 8/1977 | Watanabe et al. | 101/93.29 |
| 4,172,419 | 10/1979 | Munyon | 101/125 |
| 4,203,362 | 5/1980 | Underwood et al. | 101/327 |

FOREIGN PATENT DOCUMENTS

| | | | |
|---|---|---|---|
| 2045517 | 3/1972 | Fed. Rep. of Germany | 101/93.29 |

*Primary Examiner*—Clifford D. Crowder
*Assistant Examiner*—David J. Isabella
*Attorney, Agent, or Firm*—Andrus, Sceales, Starke & Sawall

[57] ABSTRACT

A hand operated ink stamp comprising an outer casing having an open bottom and an opening in the upper surface. A printing die impregnated with ink is disposed within the casing and is carried by a die holder having an upper magnetically susceptible surface. Mounted within the upper portion of the casing is a magnet, and the magnetic force will hold the die holder and die at a raised position above the surface to be printed. A stem is mounted for sliding movement in the opening in the upper surface of the casing and is connected through a ball and socket joint to the die holder. Manually depressing the stem will overcome the magnetic force to release the die holder from the magnet and cause the die to contact the surface to be printed. The position of the magnet within the casing can be adjusted to thereby vary the printing impression.

3 Claims, 4 Drawing Figures

FIG. 1
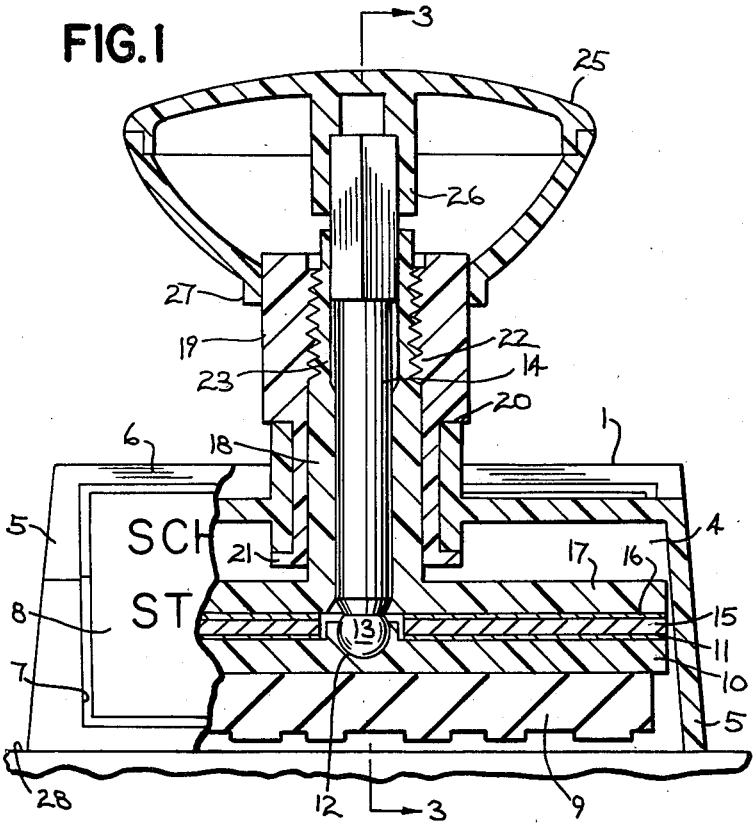
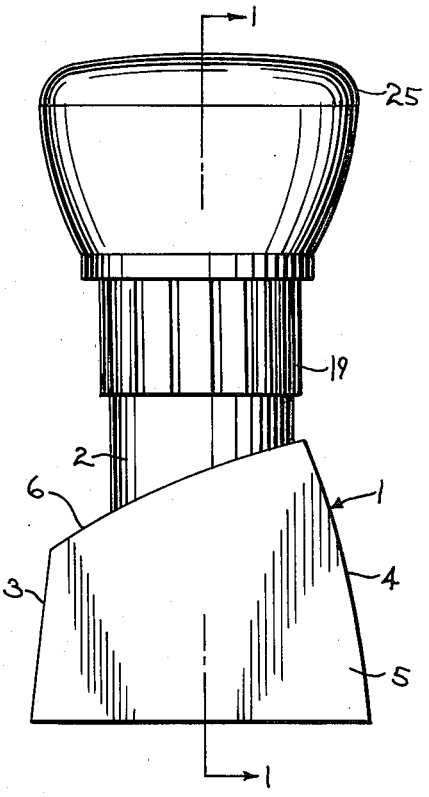
FIG. 2
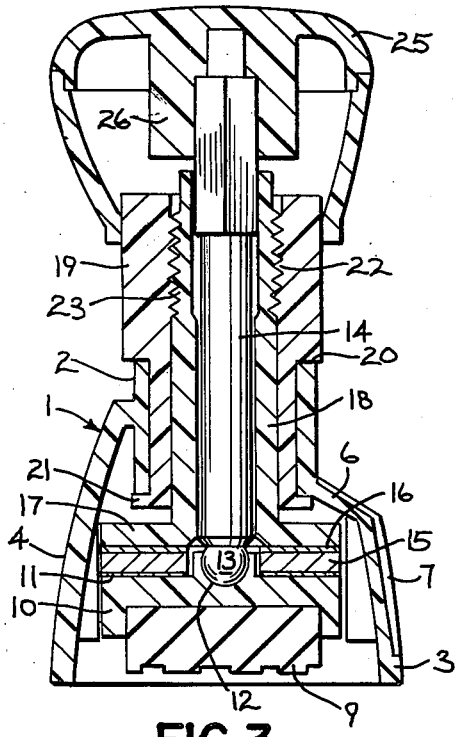
FIG. 3
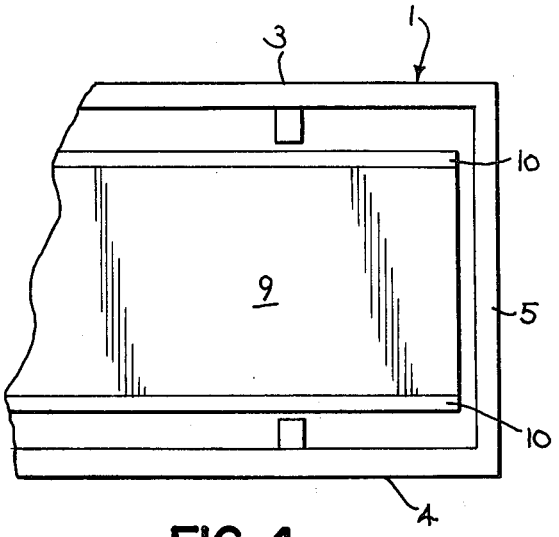
FIG. 4

VARIABLE IMPRESSION HAND STAMP

BACKGROUND OF THE INVENTION

In the conventional hand operated ink stamp, the printing die, which is impregnated with ink, is mounted on the lower surface of a die holder contained within an outer housing or casing. A stem or shaft is connected to the upper surface of the die holder and projects upwardly through an opening in the housing and carries a handle. In conventional constructions, as disclosed in U.S. Pat. Nos. 4,022,127 and 4,172,419, the die holder is biased to a raised position, in which the die is disposed out of contact with the surface to be printed, by a compression spring which is located around the stem and is interposed between the casing and the stem or outer handle. By applying a manual force to the upper end of the handle, the spring force will be overcome to move the die downwardly into contact with the surface to be printed. In the conventional spring-biased ink stamp, the spring force is variable and increases as the handle and die are lowered. In some situations, where an operator is required to operate the stamp for long periods, the continual application of manual pressure to overcome the spring force can be fatiguing.

Ball and socket connections between the stem and die holder are known, as disclosed in U.S. Pat. No. 8,388.

It is also known to incorporate an adjustment in an ink stamp in which the position of the lower extremity of the die can be varied with respect to the surface to be printed, as disclosed in U.S. Pat. No. 4,022,127, in order to vary the amount of ink which is imprinted.

SUMMARY OF THE INVENTION

The invention is directed to an improved hand operated ink stamp in which the die holder and ink impregnated die are held in a raised position with respect to the outer housing by magnetic force. In accordance with the construction of the invention, the stamp includes an outer casing or housing having an open bottom and a printing die impregnated with ink is mounted on a die holder and disposed within the casing. The upper surface of the die holder is provided with a magnetically susceptible plate which is normally attracted to a magnet that is mounted in the upper portion of the casing. With the magnetically susceptible plate held against the surface of the magnet, the die will be spaced from the surface to be printed.

To release the magnetic connection and lower the die into contact with the surface to be printed, a stem or shaft is connected to the upper surface of the die holder through a ball and socket connection and the stem extends upwardly through an opening in the upper surface of the casing and carries a handle or knob. By manually applying a downward force to the handle, the magnetic connection between the magnet and the die holder will be released, to thereby enable the die to be moved downwardly into contact with the surface to be printed. Once the magnet connection is released, the die holder and die can be moved downwardly into contact with the surface to be printed with minimum force.

The invention also includes a provision for adjusting the length of the stroke of the die to thereby vary the amount of ink which is imprinted on the surface and obtain a lighter or darker imprint. In this regard, a sleeve is disposed outwardly around the stem and the lower end of the sleeve is secured to the magnet. The upper end of the sleeve is threaded to a barrel that is mounted for rotation with respect to the casing. By rotating the barrel, the sleeve and magnet can be raised and lowered with respect to the casing, thus providing an adjustment for the raised position of the die holder and die. By moving the magnet upward within the casing, a lighter imprint can be achieved, and conversely, by lowering the magnet through rotation of the barrel a darker imprint will be obtained.

The ball and socket connection between the stem and die holder enables a uniform imprint to be obtained even though the manual force may be applied to the side edge of the handle. In the past, guides have normally been provided to insure that the die holder and die would move vertically within the outer casing and not tilt. By utilizing the ball and socket connection, the guide construction can be simplified, for the die holder and die will move vertically even though the manual force is offset from the axis of the stem.

Other objects and advantages will appear in the course of the following description.

DESCRIPTION OF THE DRAWINGS

The drawings illustrate the best mode presently contemplated of carrying out the invention.

In the drawings:

FIG. 1 is a vertical section of the ink stamp of the invention;

FIG. 2 is a side view of the ink stamp;

FIG. 3 is a section taken along line 3—3 of FIG. 1; and

FIG. 4 is an enlarged fragmentary bottom view of the stamp;

DESCRIPTION OF THE PREFERRED EMBODIMENT

As illustrated in the drawings, the ink stamp of the invention includes an outer casing or housing 1 having an opening in the upper surface which is bordered by a flange 2. The casing is composed of a front wall 3 a rear wall 4 and a pair of side walls 5. In addition, a sloping top wall 6 connects the upper edges of the front wall, rear wall, and side walls. The front wall 3 and top wall 6 are provided with connecting recesses 7 and a label 8 is secured within the recesses 7. As the label 8 extends within the sloping recess in the top wall 6, it is more readily visible to the operator.

A microporous plastic die 9 impregnated with ink is located within the casing 1 and is carried by a channel-shaped die holder 10. A magnetically susceptible metal plate 11 formed of steel, or the like, is secured, preferably through an adhesive, to the upper surface of the die holder 10, and the central portion of the die holder is provided with a spherical socket 12 which received a ball 13 mounted on the lower end of stem 14. Vertical movement of the stem 14 within flange openings 2 will cause the die holder 10 and die 9 to be moved toward and away from the surface to be printed.

To hold the die holder and die in a raised position out of contact with the surface to be printed, a magnet 15 is mounted within the upper portion of the casing 1 above the die holder 10. The force of the magnet 15 will attract the magnetically susceptible plate 11 attached to the die holder 10 to thereby draw the die holder and die upwardly to the raised position.

A metal plate 16 is attached to the upper surface of magnet 15 through an adhesive and the plate 16, in turn, is connected through an adhesive to the lower surface of a plastic base 17. Extending upwardly from the central portion of base 17 is a sleeve 18 which is disposed outwardly of the stem 14.

An adjusting mechanism is provided to vary the position of the magnet within the casing and thereby adjust the upper or elevated position of the die 9. In this regard, a barrel 19 is mounted for rotation with respect to the casing 1 and the barrel is provided with a pair of vertically spaced shoulders 20 and 21 which are located on opposite ends of the flange 2 of casing 1. The connection of the shoulders 20 and 21 to the flange permits free rotation of the barrel relative to the casing, but prevents axial movement of the barrel with respect to the casing.

The barrel 19 is provided with an internal thread 22 which is engaged with the external thread 23 on the upper end of the sleeve 18. By rotating the barrel, the sleeve 18 and magnet 15 can be raised and lowered relative to the casing.

Secured to the upper end of the stem 14 is a handle or kob 25. The upper end of the stem is staked or otherwise secured within an internal boss 26 in the handle to prevent relative movement between the stem and the handle. As best illustrated in FIG. 1 the lower portion of the handle is provided with an annular flange 27 which is located outwardly of the upper end of the barrel 19.

Due to the force of the magnet 15, the die holder 10 and die 9 will be held at an elevated position, as shown in FIG. 1, above the surface 28 to be printed. When it is desired to print on the surface 28, the operator presses downwardly on handle 25 and the manual force will overcome the magnetic force to thereby release the die holder from engagement with the magnet and enable the die to be moved downwardly into contact with the surface 28. On release of the manual force, force of the magnet 15 will draw the die holder 10 and die 9 upwardly to the raised position as shown in FIG. 1.

The ball and sprocket connection between the stem and die holder will provide a uniform imprint on surface 28, even though the manual force may be applied to the edge of the handle 25, in a position offset from the axis of the stem 14.

By rotating barrel 19, the sleeve 18 will be threaded up or down to thereby vary the position of of the magnet 15 and thus the stroke of the die holder 10 and die 9. By raising the magnet, the imprint will be lighter, and conversely, by lowering the magnet, the imprint will be darker. The adjustment also compensates for shrinkage of the microporous plastic die during service.

Various modes of carrying out the invention are contemplated as being within the scope of the following claims particularly pointing out and distinctly claiming the subject matter which is regarded as the invention.

I claim:

1. An ink stamp, comprising a casing having an open bottom bordered by a bottom edge and having a top wall formed with an opening, a printing die to be impregnated with ink disposed within the casing and normally disposed above said bottom edge, said die adapted to print an image on a surface, a die holder secured to the upper surface of the die and disposed within the casing, a base disposed within the case above said die holder, a stem disposed for sliding vertical movement within said opening and the lower end of the stem engaged with the die holder, whereby vertical movement of said stem will raise and lower the die holder and the die, a handle secured to the upper end of the stem, said handle, stem and die holder constituting an integral structure, biasing means for biasing the die holder upwardly into engagement with said base, a barrel rotatably mounted with respect to the casing and bordering said opening, said barrel being fixed against axial movement with respect to said casing, and a sleeve threadedly engaged with the barrel, the inner end of said sleeve being connected to said base, said stem being slidably disposed within said sleeve, whereby a downward force applied to said handle will move the die holder downwardly to bring the die into contact with said surface, rotation of said barrel causing said sleeve to move vertically to thereby vary the vertical position of said base and correspondingly vary the position of said die holder and die with respet to said bottom edge.

2. The stamp of claim 1, and including a ball and socket connection interconnecting the inner end of the stem and the die holder.

3. The ink stamp of claim 1, wherein said biasing means comprises magnetic means.

* * * * *